US012297824B2

(12) United States Patent
Li et al.

(10) Patent No.: US 12,297,824 B2
(45) Date of Patent: May 13, 2025

(54) PLUNGER PUMP WITH FAULT DIAGNOSIS STRUCTURE

(71) Applicant: Yantai Jereh Petroleum Equipment & Technologies Co., Ltd., Yantai (CN)

(72) Inventors: Bingzhuang Li, Yantai (CN); Ruijie Du, Yantai (CN); Zhongquan Sun, Yantai (CN); Wenping Cui, Yantai (CN); Peng Li, Yantai (CN); Baoguo Jian, Yantai (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 128 days.

(21) Appl. No.: 17/973,551

(22) Filed: Oct. 26, 2022

(65) Prior Publication Data

US 2023/0144116 A1 May 11, 2023

(30) Foreign Application Priority Data

Nov. 10, 2021 (CN) ..... 202122749185.4

(51) Int. Cl.
*F04B 49/06* (2006.01)
*F04B 53/14* (2006.01)
*F04B 53/18* (2006.01)

(52) U.S. Cl.
CPC ..... *F04B 49/065* (2013.01); *F04B 53/147* (2013.01); *F04B 53/18* (2013.01); *F04B 2201/0402* (2013.01)

(58) Field of Classification Search
CPC ..... F04B 49/065; F04B 53/147; F04B 53/18; F04B 2201/0402; F04B 51/00
See application file for complete search history.

(56) References Cited

U.S. PATENT DOCUMENTS 5,846,056 A * 12/1998 Dhindsa ..... F04B 49/065 73/152.52
6,882,960 B2 * 4/2005 Miller ..... F04B 51/00 702/182

(Continued)

FOREIGN PATENT DOCUMENTS

CN 104481868 A * 4/2015
CN 212536030 U * 2/2021

(Continued)

OTHER PUBLICATIONS

Fossen (Radar Based Sensors—A new Technology for real-time, direct temperature monitoring of crank and crosshead bearings of diesels and hazardous media reciprocating compressors, 2006). (Year: 2006).*

*Primary Examiner* — Nathan C Zollinger
(74) *Attorney, Agent, or Firm* — XSENSUS LLP

(57) ABSTRACT

The present application relates to a plunger pump, and the technical field of high-pressure media transport equipment. The plunger pump comprises a fixed component, a motion component and a fault diagnosis module, the motion component is provided on the fixed component, and the motion component is movable relative to the fixed component. The fault diagnosis module comprises a temperature sensing component and a processing unit, the fixed component is provided with one or more temperature detection holes, the temperature sensing component is at least partially located in the one or more temperature detection holes, and the temperature sensing component is contactable to lubricating oil flowing through the motion component; the processing unit is connected to the temperature sensing component, and the processing unit performs monitoring and fault diagnosis on the plunger pump based on a temperature value sensed by the temperature sensing component.

9 Claims, 6 Drawing Sheets

(56) References Cited

U.S. PATENT DOCUMENTS

| | | | | |
|---|---|---|---|---|
| 11,047,379 | B1 * | 6/2021 | Li | F04B 51/00 |
| 2012/0183247 | A1 * | 7/2012 | Chamberlin | H02K 11/25<br>384/448 |
| 2014/0166132 | A1 * | 6/2014 | Roberts | F04B 49/065<br>137/557 |
| 2014/0190154 | A1 * | 7/2014 | Berger | F01M 13/04<br>60/370 |

FOREIGN PATENT DOCUMENTS

| | | | | |
|---|---|---|---|---|
| EP | 3480461 | A1 * | 5/2019 | |
| WO | WO-2005108744 | A1 * | 11/2005 | F04B 51/00 |
| WO | WO-2018156152 | A1 * | 8/2018 | F04B 1/0404 |

* cited by examiner

PLUNGER PUMP WITH FAULT DIAGNOSIS STRUCTURE

CROSS-REFERENCE TO RELATED APPLICATION

This application claims priority from Chinese Patent Application No, 202122749185.4, filed on Nov. 10, 2021, the contents of which are incorporated by reference herein in its entirety.

TECHNICAL FIELD

The present application relates to the technical field of high-pressure media transport equipment, especially relates to a plunger pump.

BACKGROUND

As a kind of equipment to transport high-pressure medium, A plunger pump is widely used in oil and gas extraction. In the process of oil and gas extraction, the plunger pump can pump the fracturing medium to the formation at high pressure to press the formation open and form fractures, so as to achieve the purpose of increasing production and injection in oil and gas fields. The plunger pump is used under harsh working conditions, high equipment load, and the equipment is accompanied by violent vibration during operation. Therefore, the key load-bearing parts in the plunger pump are prone to abnormal damage. If the damage to the key load-hearing parts of the plunger pump is not found in time, it is easy to cause the negative impact of the damaged parts to extend to other parts in the plunger pump, causing more serious damage.

At present, plunger pumps in oil-gas field and well sites are usually replaced for preventive maintenance based on the production plan and experience of the operator. In the maintenance process, the parts of the plunger pump need to be disassembled to detect whether there is damage to the parts in the plunger pump. Under this maintenance system, disassembly and inspection are performed regardless of equipment failure, which is wasteful of labor and materials and blind.

SUMMARY

The present application discloses a plunger pump to solve the problem of plunger pumps requiring blind disassembly and maintenance.

In order to solve the above problem, the present application uses the following technical solutions.

The plunger pump of the present application comprises a fixed component, a motion component and a fault diagnosis module, the motion component is provided on the fixed component, and the motion component is movable relative to the fixed component. The fault diagnosis module comprises a temperature sensing component and a processing unit, the fixed component is provided with one or more temperature detection holes, the temperature sensing component is at least partially located in the one or more temperature detection holes, and the temperature sensing component is contactable to lubricating oil flowing through the motion component; the processing unit is connected to the temperature sensing component, and the processing unit performs monitoring and fault diagnosis on the plunger pump based on a temperature value sensed by the temperature sensing component.

Further, the fault diagnosis module further comprises a display unit, which is connected to the processing unit, and the display unit is used to display a monitoring and fault diagnostic result of the plunger pump.

Further, the fixed component comprises a crosshead slide, the motion component comprises a crosshead assembly, the crosshead assembly slides to fit with the crosshead slide. The crosshead slide is provided with one or more first detection holes, which crosses through the crosshead slide to a side of the crosshead slide near the crosshead assembly, the temperature sensing component comprises one or more first temperature sensors, which is provided in the one or more first detection holes.

Further, the end of the one or more first temperature sensors near the crosshead assembly does not protrude from a side of the crosshead slide near the crosshead assembly.

Further, the crosshead slide has a cylinder shape. There is a plurality of the first detection holes. The one or more first temperature sensors have a one-to-one correspondence to the first detection holes, and the first detection holes are arranged along a circumference of the crosshead slide.

Further, the crosshead slide is provided with an oil guide chamber and one or more second detection holes. The oil guide chamber communicates with a gap between the crosshead slide and the crosshead assembly. Lubricating oil between the crosshead slide and the crosshead assembly flows into the oil guide chamber. The one or more second detection holes communicates with the oil guide chamber. The temperature sensing component comprises one or more second temperature sensors, the one or more second temperature sensors is provided in the one or more second detection holes.

Further the one or more second detection holes is provided at a bottom of the oil guide chamber.

Further, the fixed component further comprises a housing, the motion component further comprises a connecting rod bearing bush, and the temperature sensing component further comprises one or more third temperature sensors; the housing is provided with one or more third detection holes, the one or more third detection holes is located below the connecting rod bearing bush, the one or more third temperature sensors is provided in the one or more third detection holes, and lubricating oil flowing through the connecting rod bearing bush can drip down to the one or more third temperature sensors.

Further, there is a plurality of the third detection holes, and the third detection holes have a one-to-one correspondence to the one or more third temperature sensors, and the third detection holes are arranged in a rotation direction of the connecting rod bearing bush.

Further, the plunger pump further comprises a bearing and a bearing housing, and the temperature sensing component further comprises one or more fourth temperature sensors, and the bearing housing is provided with one or more fourth detection holes, and the one or more fourth temperature sensors are provided in the one or more fourth detection holes.

The technical solution adopted by the present application can achieve the following beneficial effects.

The embodiments of the present application disclose that the temperature of the lubricating oil flowing through the motion component is monitored by providing one or more temperature detection holes in the fixed component, and using a temperature sensing component provided in the one or more temperature detection holes. One of the purposes of the lubricating oil is to reduce the frictional resistance of the movement of the motion component, and the other is to carry away the heat generated by the mutual friction between the motion component and the fixed component. Therefore, changes in the temperature of the lubricating oil flowing through the motion component can reflect changes in the temperature of the motion component. Moreover, the lubricating oil flows directly between the motion component and the fixed component, and has direct heat transfer with the motion component and the fixed component. Therefore, the above-mentioned solution can improve the accuracy of working state monitoring and fault diagnosis of the plunger pump.

BRIEF DESCRIPTION OF DRAWINGS

The accompanying drawings illustrated herein are used to provide a further understanding of the present application and form part of the present application. The schematic embodiments of the present application and their descriptions are used to explain the present application and do not constitute an undue limitation of the present application. In the drawings.

REFERENCE SIGNS

100—temperature sensing component; 110—first temperature sensor; 120—second temperature sensor; 130—third temperature sensor; 140—fourth temperature sensor;
200—processing unit;
300—display unit;
400—crosshead slide; 410—oil guide chamber; 420—connecting rod;
500—crosshead assembly.
600—housing; 610—support plate;
700—connecting rod bearing bush;
800—bearing; 810—crankshaft;
900—bearing housing; 910—crankshaft bearing;
1000—power end assembly;
1100—hydraulic end assembly; 1110—valve box; 1120—plunger; 1130—upper valve; 1140—lower valve;
1200—reduction gearbox assembly;
1300—power end housing.

DETAILED DESCRIPTION

In order to make the purpose, technical solutions and advantages of the present application clearer, the following will be combined with specific embodiments of the present application and the corresponding drawings to clearly and completely describe the technical solutions of the present application. Obviously, the described embodiments are only part of the embodiments of the present application, but not all of them. Based on the embodiments in the present application; all other embodiments obtained by a person of ordinary skill in the art without creative labor belong to the protection scope of the present application.

The technical solutions disclosed in various embodiments of the present application are described in detail below in conjunction with FIGS. 1 to 9.

The application discloses a plunger pump including a fixed component, a motion component and a fault diagnosis module. Optionally, the motion component is provided on the fixed component, and the motion component is movable relative to the fixed component. It should be noted that the fixed component described in the present application can be: a component in the plunger pump that is fixed relative to a housing 600 of the plunger pump when the plunger pump is in a working state. The motion component is: a component that moves relative to the fixed component when the plunger pump is in the working state. The motion component being movable relative to the fixed component can be that: the motion component slides relative to the fixed component, or the motion component rotates relative to the fixed component.

Figure 9:
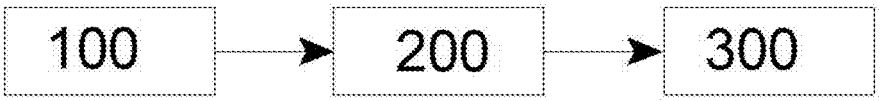
FIG. 9 is a schematic diagram of a fault diagnosis module disclosed in an embodiment of the present application.

Referring to FIG. 9, in an optional embodiment, the fault diagnosis module includes a temperature sensing component 100 and a processing unit 200, the fixed component is provided with one or more temperature detection holes, the temperature sensing component 100 is at least partially located in the one or more temperature detection holes, and the temperature sensing component 100 is contactable to lubricating oil flowing through the motion component. The processing unit 200 is connected to the temperature sensing component 100, and the processing unit 200 performs monitoring and fault diagnosis on the plunger pump based on a temperature value sensed by the temperature sensing component 100.

The temperature sensing component 100 being contactable to the lubricating oil flowing through the motion component either refers to that the lubricating oil flows through the temperature sensing component 100, or the temperature sensing component 100 is at least partially immersed in the lubricating oil so that the temperature sensing component 100 may sense the temperature of the lubricating oil flowing through the motion component. The sensed temperature value is used as an input value to the processing unit 200 to perform monitoring and fault diagnosis on the plunger pump. Therefore, it is possible to detect the working state of each motion component in the plunger pump and perform fault diagnosis on the plunger pump without disassembling the plunger pump. This eliminates the need to blindly disassemble the plunger pump for maintenance. Exemplarily, the processing unit 200 can be a single chip microcomputer.

It should be noted that as the lubricating oil flows through the motion component, heat exchange occurs between the motion component and the lubricating oil. In the event of a failure of the motion component in the plunger pump and the fixed component that works with the motion component, there will be a local temperature increase in both the motion component and the fixed component that works with the motion component. In the event of a failure of the motion component of the plunger pump, the temperature of the lubricating oil flowing through the motion component will increase. Thus, monitoring and diagnosing faults in the plunger pump can be performed by monitoring the temperature of the lubricating oil flowing through the motion component. Exemplarily, in the case where the temperature sensing component 100 senses a temperature value that is outside of a predetermined temperature range, there is a failure in the corresponding motion component of the plunger pump. In the case where the temperature sensing component 100 senses a temperature value within a predetermined temperature range, the corresponding motion component of the plunger pump is normal. Specifically, the predetermined temperature range corresponding to the motion component can be obtained based on experience or extensive experiments. Moreover, different plunger pumps correspond to different predetermined temperature ranges, and the motion components at different positions in the same plunger pump correspond to different predetermined temperature ranges. Therefore, the present application does not limit the predetermined temperature range.

It should be noted that in order to achieve lubrication, the lubricating oil normally flows between two relatively sliding contact surfaces, and the motion component and the fixed component are warmed up due to the friction between the two relatively sliding contact surfaces. Therefore, the temperature of the lubricating oil is closer to the temperature of the motion component, and thus the accuracy and timeliness of monitoring and fault diagnosis of the plunger pump can be improved by detecting the temperature of the lubricating oil flowing through the motion component.

Referring to FIG. 9, the fault diagnosis module further includes a display unit 300, which is connected to the processing unit 200, and the display unit 300 is used to display a monitoring and fault diagnostic result of the plunger pump. Exemplarily, the display unit may be a screen or an alarm light. There are many types of display units 300. For this reason, this embodiment does not limit the specific type of the display unit 300.

It is easy for an operator to observe the working state of the plunger pump and the parts of the plunger pump that are malfunctioning in a timely manner in the above embodiment by providing a display unit 300. In an optional embodiment, the fault diagnosis module may also include an alarm, the alarm is connected to the processing unit 200, so that the alarm can be issued in the event of a failure of the plunger pump. Exemplarily, the alarm may be an alarm light or a buzzer. There are many types of alarms, and for this reason this embodiment does not limit the specific type of alarm.

Referring to FIGS. 1 to 4, the plunger pump includes a power end assembly 1000, a hydraulic end assembly 1100 and a reduction gearbox assembly 1200. The power end assembly 1000 includes a power end housing 1300, a crosshead slide 400 and a cage. A crankshaft mechanism is provided in the power end housing 1300. The crankshaft mechanism includes a crankshaft 810 and a crankshaft bearing 910. A connecting rod 420 and a crosshead assembly 500, etc., are provided in the crosshead slide 400. The hydraulic end assembly 1100 includes a valve box 1110, a plunger 1120, a suction valve, a discharge valve, an upper valve 1130 and a lower valve 1140, etc. The crankshaft 810 rotates on the crankshaft bearing 910. One end of the connecting rod 420 is connected to the crankshaft 810, the other end of the connecting rod 420 is connected to the crosshead assembly 500. The opposite end of the crosshead assembly 500 is connected to the plunger 1120 through a pull rod. An external power source drives the crankshaft 810 for rotational motion through the reduction gearbox assembly 1200. The rotational motion of the crankshaft 810 is finally transformed into a linear reciprocating motion of the plunger 1120, so as to realize the opening and closing of the suction valve and discharge valve, i.e., the hydraulic end assembly 1100 suctions low pressure liquid and discharges high pressure liquid.

Figure 5:
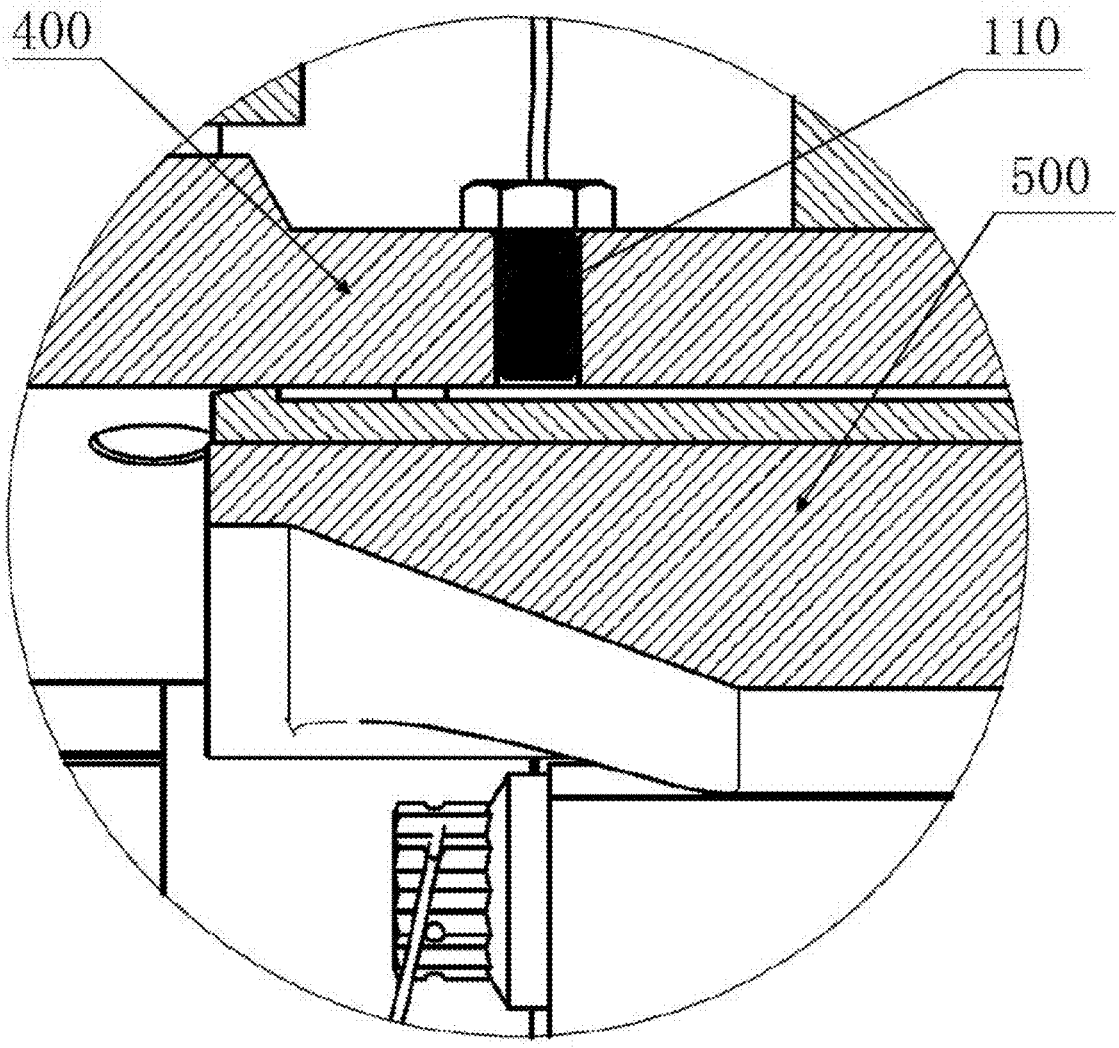
FIG. 5 is a schematic diagram of the installation of a first temperature sensor disclosed in an embodiment of the present application.

Referring to FIG. 5, in an optional embodiment, the fixed component includes a crosshead slide 400, and the motion component includes a crosshead assembly 500, and the crosshead assembly 500 slides to fit with the crosshead slide 400. The crosshead slide 400 is provided with one or more first detection holes, which run through the crosshead slide 400 to a side of the crosshead slide 400 close to the crosshead assembly 500, the temperature sensing component 100 includes one or more first temperature sensors 110, which is provided in the one or more first detection holes.

With the plunger pump in the working state, the crosshead assembly 500 reciprocates relative to the crosshead slide 400, The one or more first detection holes run through the crosshead slide 400 to the side of the crosshead slide 400 close to the crosshead assembly 500, so that the lubricating oil located between the crosshead assembly 500 and the crosshead slide 400 can enter the one or more first detection holes, and then contact the one or more first temperature sensors 110, so that the one or more first temperature sensors 110 can sense the temperature of the lubricating oil between the crosshead assembly 500 and the crosshead slide 400, and then the temperature of the lubricating oil between the crosshead assembly 500 and the crosshead slide 400 is used to determine whether the crosshead assembly 500 or the crosshead slide 400 is malfunctioning. Exemplarily, the one or more first temperature sensors 110 may be in screw-thread fit with the one or more first detection holes.

Referring to FIG. 5, the end of the one or more first temperature sensors 110 close to the crosshead assembly 500 does not protrude from the side of the crosshead slide 400 close to the crosshead assembly 500 to avoid collision of the one or more first temperature sensors 110 with the crosshead assembly 500. An end of the one or more first temperature sensors 110 close to the crosshead assembly 500 does not protrude from the side of the crosshead slide 400 close to the crosshead assembly 500 may be that, the end of the one or more first temperature sensors 110 close to the crosshead assembly 500 is recessed into the surface of the side of the crosshead slide 400 close to the crosshead assembly 500, or the end of the one or more first temperature sensors 110 close to the crosshead assembly 500 is flush with the surface of the side of the crosshead slide 400 close to the crosshead assembly 500.

Figure 1:
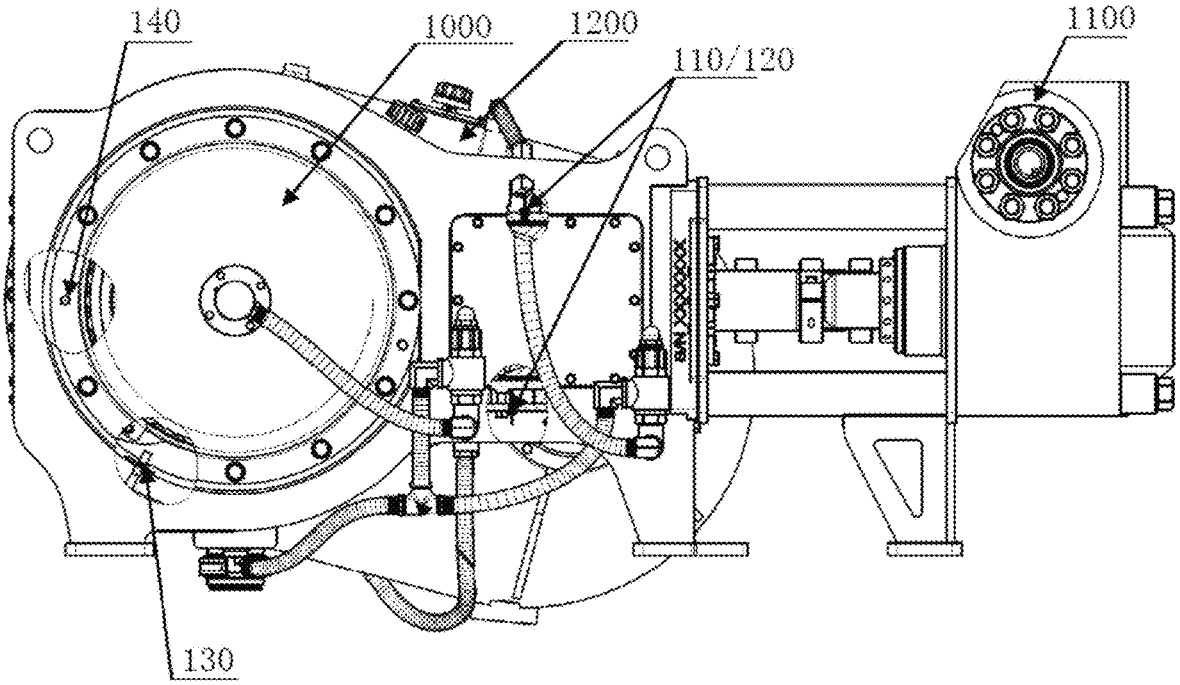
FIG. 1 is a schematic diagram of a plunger pump disclosed in an embodiment of the present application in a first view.
Figure 2:
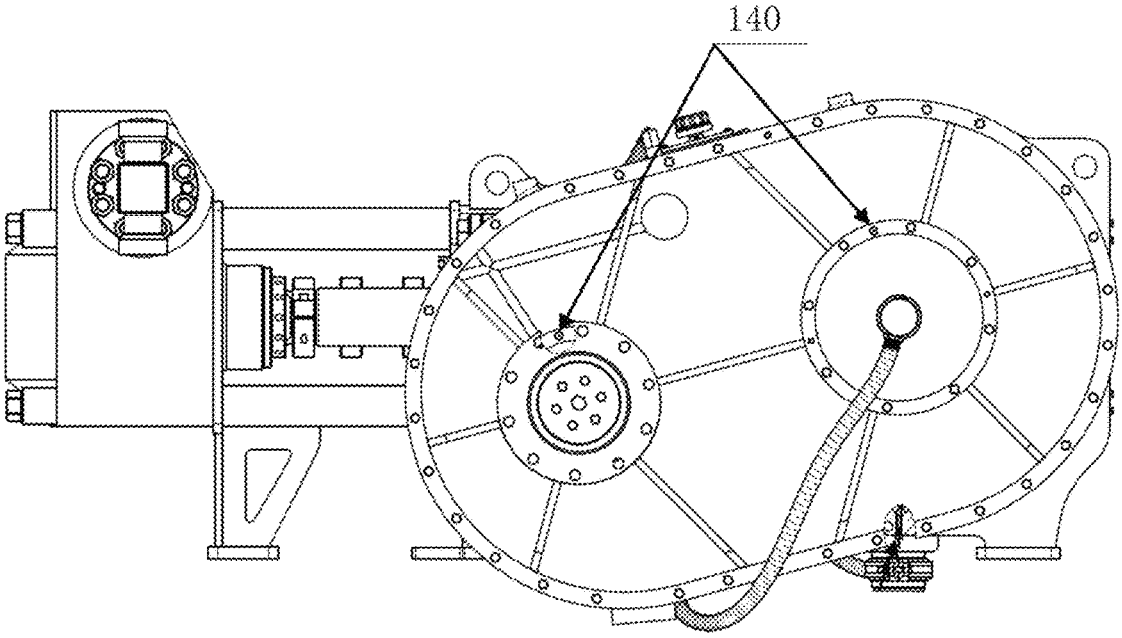
FIG. 2 is a schematic diagram of a plunger pump disclosed in an embodiment of the present application in a second view.
Figure 3:
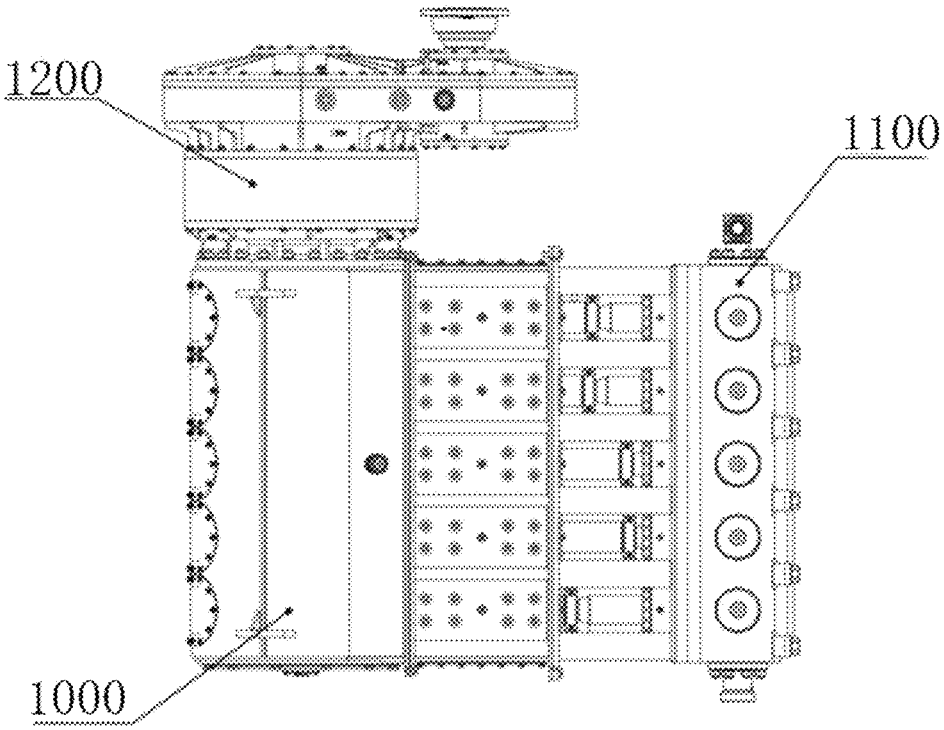
FIG. 3 is a schematic diagram of a plunger pump disclosed in an embodiment of the present application in a third view.
Figure 4:
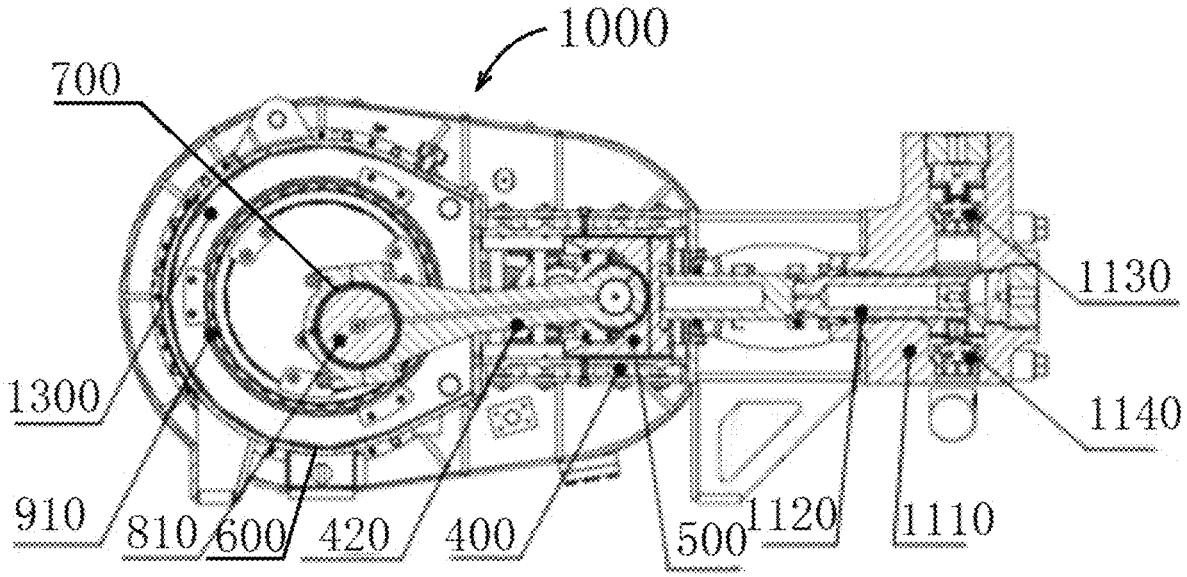
FIG. 4 is a schematic diagram of a cross-section of a plunger pump disclosed in an embodiment of the present application.

Referring to FIG. 4, the crosshead slide 400 is in the shape of a cylinder. There is a plurality of the first detection holes. The first temperature sensors 110 have a one-to-one correspondence to the first detection holes, and the first detection holes are arranged along the circumference of the crosshead slide 400. By providing a plurality of first temperature sensors 110 in the embodiment, the temperature values sensed by the plurality of first temperature sensors 110 can be processed by the processing unit 200 to obtain a more accurate temperature, and on the other hand, monitoring and fault diagnosis can be implemented for the moving component and different parts. Exemplarily, an average of the temperature values sensed by the plurality of first temperature sensors 110 can be used as an input value of the processing unit 200. Of course, other processing methods are possible, and for this reason, this embodiment does not limit the specific method of processing the temperature values sensed by the plurality of first temperature sensors 110 by the processing unit 200.

Figure 6:
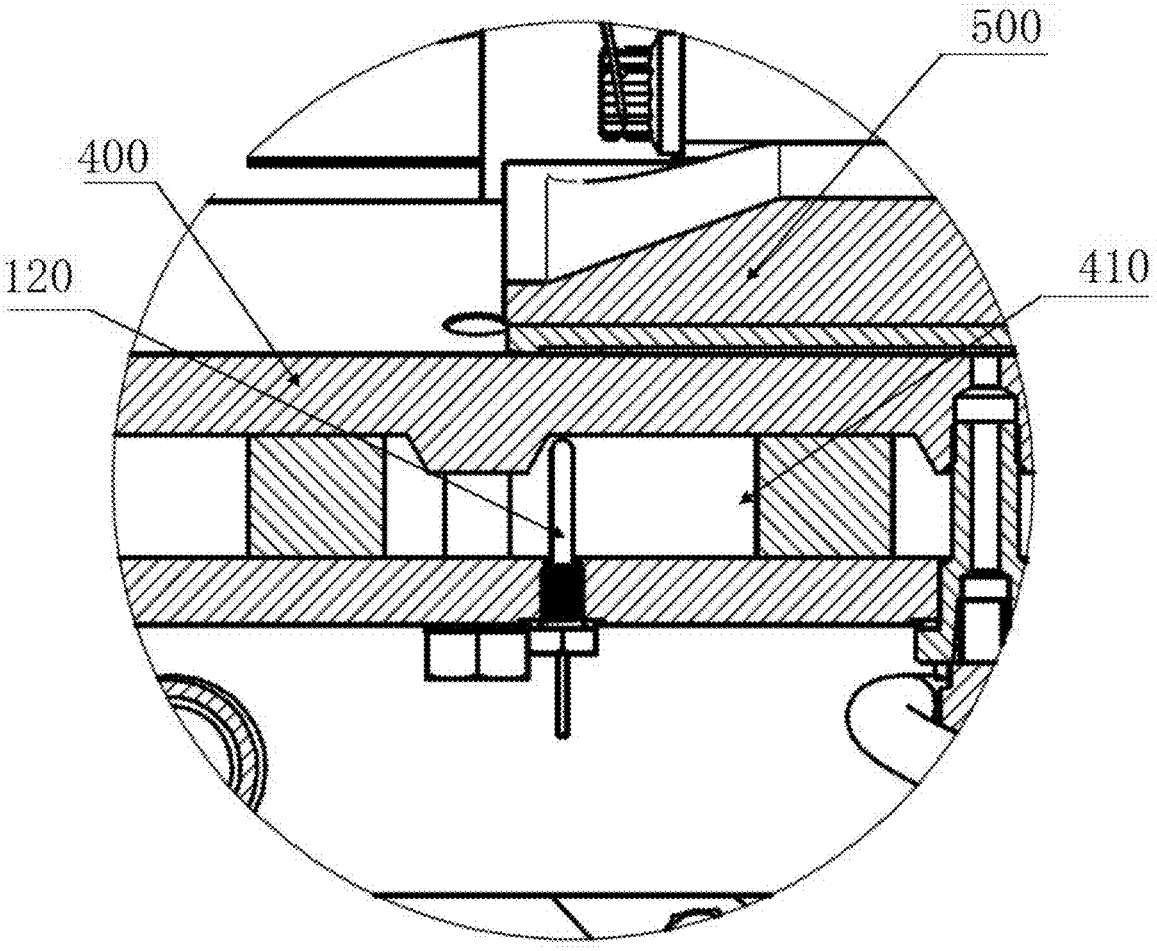
FIG. 6 is a schematic diagram of the installation of a second temperature sensor disclosed in an embodiment of the present application.

Referring to FIG. 6, the crosshead slide 400 is provided with an oil guide chamber 410 and one or more second detection holes. The oil guide chamber 410 communicates with a gap between the crosshead slide 400 and the crosshead assembly 500. Lubricating oil between the crosshead slide 400 and the crosshead assembly 500 flows into the oil guide chamber 410. The one or more second detection holes communicates with the oil guide chamber 410. The temperature sensing component 100 includes one or more second temperature sensors 120, and the one or more second temperature sensors 120 are provided in the one or more second detection holes. Exemplarily, the lubricating oil between the crosshead slide 400 and the crosshead assembly 500 enters the oil guide chamber 410 after heat exchange between the crosshead slide 400 and/or the crosshead assembly 500, and thus the temperature of the lubricating oil in the oil guide chamber 410 varies with the temperature of the crosshead slide 400 and the crosshead assembly 500. Specifically, in the event of a failure of the crosshead assembly 500, the temperature of the crosshead assembly 500 increases, which in turn causes the temperature of the lubricating oil in the oil guide chamber 410 to increase. Thus, monitoring and fault diagnosis of the working state of the crosshead assembly 500 can be performed by monitoring the temperature of the lubricating oil in the oil guide chamber 410.

Referring to FIG. 6, the one or more second detection holes are provided at the bottom of the oil guide chamber 410 to ensure that the lubricating oil in the oil guide chamber 410 can fully contact with the one or more second temperature sensors 120, thereby avoiding that the reduction of the lubricating oil amount affects the monitoring and fault diagnosis of the working state of the crosshead assembly 500. In an optional embodiment, there is a plurality of the second detection holes. The second temperature sensors 120 have a one-to-one correspondence to the one or more second detection holes, and the second detection holes are arranged on different sides of the plunger pump, so that the temperature of the lubricating oil in the oil guide chamber 410 can be accurately monitored even if the plunger pump is tilted.

Figure 7:
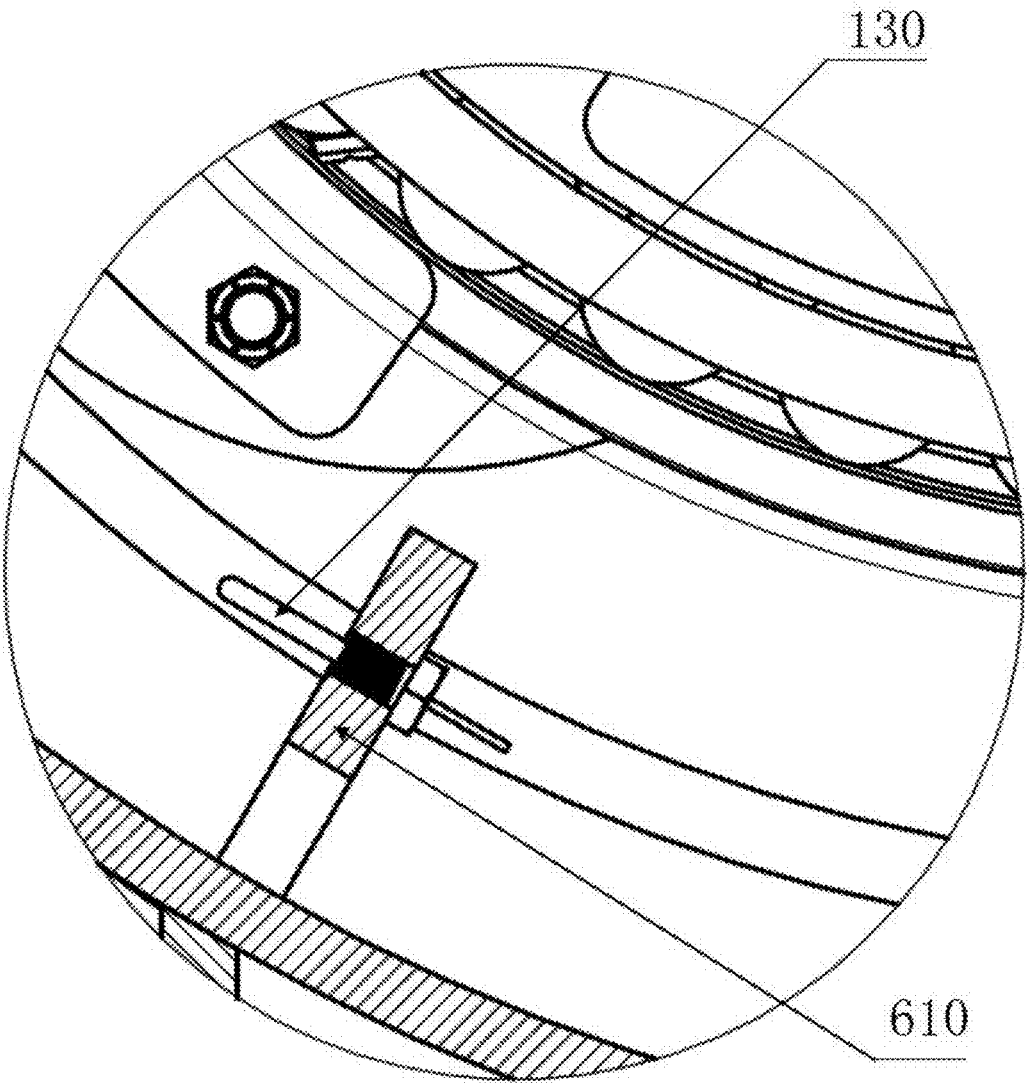
FIG. 7 is a schematic diagram of the installation of a third temperature sensor disclosed in an embodiment of the present application.
Figure 8:
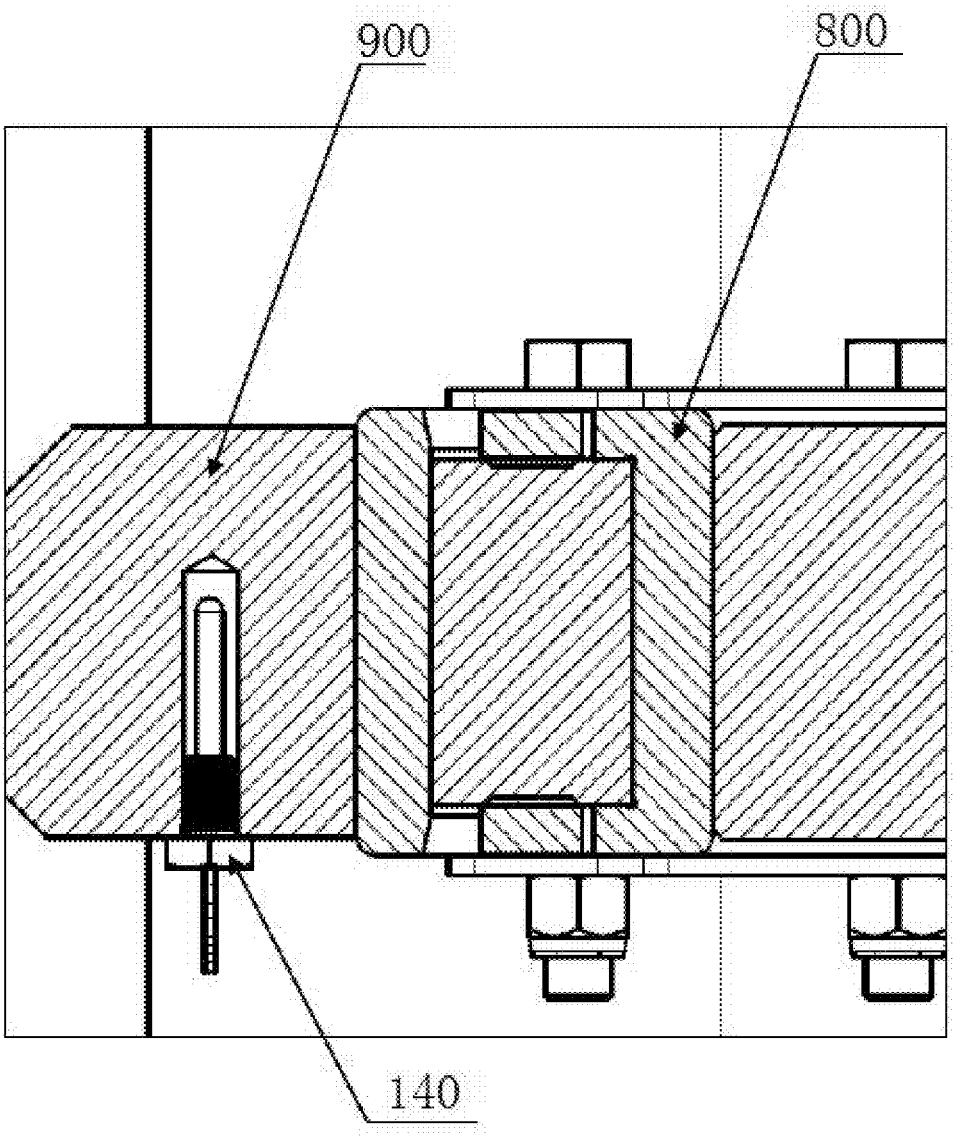
FIG. 8 is a schematic diagram of the installation of a fourth temperature sensor disclosed in an embodiment of the present application.

Referring to FIGS. 4 and 7, the fixed component further includes a housing 600, the motion component further includes a connecting rod bearing bush 700, and the temperature sensing component 100 further includes one or more third temperature sensors 130. The housing 600 is provided with one or more third detection holes, the one or more third detection holes are located below the connecting rod bearing bush 700. The one or more third temperature sensors 130 are provided in the one or more third detection holes, and lubricating oil flowing through the connecting rod bearing bush 700 can drip down to the one or more third temperature sensors 130. Exemplarily, the housing 600 includes a support plate 610. The support plate 610 is convex to the inner side of the housing 600. Further, the one or more third detection hole are provided in the support plate 610. Further, the support plate 610 may be a reinforcement plate provided on the inner side of the housing 600. In this embodiment, the lubricating oil flowing through the connecting rod bearing bush 700 drips down on the one or more third temperature sensors 130 by gravity, and the one or more third temperature sensors 130 can be used to sense the temperature of the lubricating oil flowing through the connecting rod bearing bush 700 to achieve monitoring and fault diagnosis of the working state of the connecting rod bearing bush 700.

There is a plurality of the third detection holes, and the third detection holes have a one-to-one correspondence to the third temperature sensors 130, and the third detection holes are arranged in the rotation direction of the connecting rod bearing bush 700. Referring to FIG. 4, when the plunger pump is under working state, the connecting rod bearing bush 700 rotates relative to a bearing 800, and thus a dripping position of the lubricating oil flowing through the connecting rod bearing bush 700 is in a fixed area inside the housing 600. Therefore, a plurality of third detection holes can be provided to improve the accuracy of detecting the temperature of the lubricating oil flowing through the connecting rod bearing bush 700, and thus more accurately monitor and diagnose faults of the working state of the connecting rod bearing bush 700.

In an optional embodiment, the plunger pump further includes a bearing 800 and a bearing housing 900, and the temperature sensing component 100 further includes one or more fourth temperature sensors 140, and the bearing housing 900 is provided with one or more fourth detection holes, and the one or more fourth temperature sensors 140 are provided in the one or more fourth detection holes. In this embodiment, the one or more fourth detection holes can be provided in the bearing housing 900 to enable the one or more fourth temperature sensors 140 to more accurately sense the temperature of the bearing 800, thereby improving the accuracy of monitoring and fault diagnosis of the working state of the bearing 800. Exemplarily, the bearing 800 may includes a crankshaft 810, the bearing housing 900 may includes a crankshaft bearing 910.

The above embodiments of the present application focus on the differences between various embodiments, and the different optimization features between the various embodiments can be combined to form a better embodiment as long as they do not contradict each other, in view of the brevity of the text, here is not repeated.

The above description is only embodiments of the present application, and is not used to limit the present application. To a person skilled in the art, the present application may have various changes and variations. Any modification, equivalent replacement, improvement, etc. made within the spirit and principle of the present application shall be included in the scope of the claims of the present application.

The invention claimed is:

1. A plunger pump, comprising a fixed structure, a motion structure and a fault diagnosis structure, wherein the motion structure is provided on the fixed structure, and the motion structure is movable relative to the fixed structure;

the fault diagnosis structure comprises a temperature sensor and a processor, the fixed structure is provided with one or more first temperature detection holes, the temperature sensor is at least partially located in the one or more first temperature detection holes, and the temperature sensor is directly contactable to lubricating oil flowing through the motion structure to sense a temperature value of the lubricating oil; the processor is connected to the temperature sensor, and the processor performs monitoring and fault diagnosis on the plunger pump based on the temperature value sensed by the temperature sensor, wherein the temperature sensor is not in direct contact with the motion structure;

the fixed structure comprises a crosshead slide, the motion structure comprises a crosshead assembly, the crosshead assembly slides to fit with the crosshead slide; and the crosshead slide is provided with one or more first detection holes, the one or more first temperature detection holes, the one or more first temperature detection holes crosses through the crosshead slide to a side of the crosshead slide close to the crosshead assembly, the temperature sensor comprises one or more first temperature sensors, the one or more first temperature sensors is provided in the one or more first temperature detection holes.

2. The plunger pump according to claim 1, wherein the fault diagnosis structure further comprises a display, the display is connected to the processor, and the display is configured to display a monitoring and fault diagnostic result of the plunger pump.

3. The plunger pump according to claim 1, wherein an end of the one or more first temperature sensors close to the crosshead assembly does not protrude from a side of the crosshead slide close to the crosshead assembly.

4. The plunger pump according to claim 1, wherein the crosshead slide has a cylinder shape, there is a plurality of the first temperature detection holes and first temperature sensors, the first temperature sensors have a one-to-one correspondence to the first temperature detection holes, and the first temperature detection holes are arranged along a circumference of the crosshead slide.

5. The plunger pump according to claim 1, wherein the crosshead slide is provided with an oil guide chamber and one or more second temperature detection holes, the oil guide chamber communicates with a gap between the crosshead slide and the crosshead assembly, and lubricating oil between the crosshead slide and the crosshead assembly flows into the oil guide chamber, the one or more second temperature detection holes communicates with the oil guide chamber; the temperature sensor further comprises one or more second temperature sensors, the one or more second temperature sensors is provided in the one or more second temperature detection holes.

6. The plunger pump according to claim 5, wherein the one or more second temperature detection holes is provided at a bottom of the oil guide chamber.

7. The plunger pump according to claim 1, wherein the fixed structure further comprises a housing, the motion structure further comprises a connecting rod bearing bush, and the temperature sensor further comprises one or more third temperature sensors; the housing is provided with one or more third temperature detection holes, the one or more third temperature detections holes is located below the connecting rod bearing bush, the one or more third temperature sensors is provided in the one or more third temperature detection holes, and lubricating oil flowing through the connecting rod bearing bush can drip down to the one or more third temperature sensors.

8. The plunger pump according to claim 7, wherein there is a plurality of third temperature detection holes and third temperature sensors, and the third temperature detection holes have a one-to-one correspondence to the third temperature sensors, and the third temperature detection holes are arranged in a rotation direction of the connecting rod bearing bush.

9. The plunger pump according to claim 1, wherein the plunger pump further comprises a bearing and a bearing housing, and the temperature sensor further comprises one or more fourth temperature sensors, and the bearing housing is provided with one or more fourth temperature detection holes, and the one or more fourth temperature sensors are provided in the one or more fourth temperature detection holes.

* * * * *